United States Patent [19]

Wirz

[11] Patent Number: 4,688,784

[45] Date of Patent: Aug. 25, 1987

[54] COVERING FOR SHEET-SUPPORTING CYLINDERS AND DRUMS IN ROTARY OFFSET PRINTING PRESSES

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 745,696

[22] Filed: Jun. 17, 1985

[30] Foreign Application Priority Data

Jun. 16, 1984 [DE] Fed. Rep. of Germany ..... 3422443

[51] Int. Cl.[4] ..... B65H 29/24

[52] U.S. Cl. ..... 271/195; 101/348; 226/95; 226/97; 271/196

[58] Field of Search ..... 271/194, 195, 196; 226/97, 95; 101/348, 350

[56] References Cited

U.S. PATENT DOCUMENTS

| | | | |
|---|---|---|---|
| 3,521,802 | 7/1970 | Bossons | 226/97 |
| 3,744,693 | 7/1973 | Greiner | 226/97 |
| 3,835,597 | 9/1974 | Wasil | 101/348 X |
| 4,029,249 | 6/1977 | Nagel | 226/95 |
| 4,207,998 | 6/1980 | Schmid | 226/95 |
| 4,285,275 | 8/1981 | Sato | 226/196 X |
| 4,390,119 | 6/1983 | Smetana | 226/196 |

*Primary Examiner*—Richard A. Schacher

*Attorney, Agent, or Firm*—Herbert L. Lerner; Laurence A. Greenberg

[57] ABSTRACT

A covering for sheet-supporting cylinders and drums on rotary offset printing machines for printing both on single and both sides of a sheet, the covering having a smooth surface on one side thereof and a textured surface on the opposite side thereof, with sheet-supporting surfaces projecting from the textured surface and formed of hydrophilic and chemically and wear-resistant material includes a device for defining perforations formed in the textured surface, and a device connected to the perforations for selectively applying blowing air and suction therethrough.

24 Claims, 13 Drawing Figures

COVERING FOR SHEET-SUPPORTING CYLINDERS AND DRUMS IN ROTARY OFFSET PRINTING PRESSES

The invention relates to a covering for sheet-carrying or sheet-supporting cylinders and drums in rotary offset printing presses for printing both on single and both sides of a sheet, the covering having a smooth surface on one side thereof and a textured surface on the opposite side thereof, with sheet-supporting surfaces which project from the textured surface and are intended for supporting the sheet, the projecting surfaces being preferably statistically uniformly distributed and being formed of hydrophilic, chemically resistant and wear-resistant material.

The conveyance of sheets through a printing press to the delivery is accomplished by means of cylinders and transfer drums. Depending upon the type of printing press and whether it is constructed only for single-side or both first-form and perfector printing, the cylinders and drums referred to are impression cylinders, turning cylinders, storage drums, transfer drums and delivery drums. While the sheet passes through this conveying chain, the freshly printed side of the conveyed sheet unavoidably comes to lie here-and-there upon the outer cylindrical surfaces of the aforementioned cylinders and drums. Unless special precautions are taken, the contact between the ink, which is not yet dry, and the outer cylindrical surface of the drum and cylinder, respectively, will cause a smearing of the printed image, especially if there is a slight relative motion between the outer cylindrical surface and the conveyed sheet. The cause for such relative motions may be that the sheet falls forward or drops due to its own weight i.e. the force of gravity, or that the conveying speed of the delivery chain differs slightly from the peripheral velocity of the delivery drum. A further cause for such relative motions may be that stiffer sheets or cardboards relax in the course of being conveyed. Not infrequently, specially provided sheet supporting means also cause smearing of the printed image which is not yet entirely dry. If both sides of a sheet are printed, smear-free conveyance of the sheet poses special problems. Contact between the freshly printed sides of the sheet and the outer cylindrical surfaces of the cylinders and drums as well as sheet carrying elements or machine parts which are provided in the vicinity of the sheet-supporting cylinders and drums is inevitable when using the most varied types of papers in first form and perfector printing. High-quality prints are rendered useless, however, even by relatively slight smearing.

A sheet delivery drum heretofore known from German Patent No. 1 561 043 is of double-walled construction and has a covering made of porous and air-permeable material. Air is blown into a cavity between the two walls. This air escapes through the air-permeable covering and produces an air cushion between the outer cylindrical surface of the sheet delivery drum and the freshly printed underside of the sheet being conveyed. This air cushion prevents smearing of the printed image although, as is generally known, there is a difference in speed between the sheet carried away by the delivery chain and the outer cylindrical surface of the sheet delivery drum which is still guiding the freshly printed underside.

The manufacturing expense involved in the heretofore known sheet delivery drum is considerable, however. Large quantities of blowing-air are required, moreover, in order to produce the air cushion. In addition to the cost of the equipment itself, there is a high energy demand. It is therefore impossible to use such a porous air drum at more than one point in the printing press.

The large quantity of air required by the heretofore known sheet delivery drum is associated with a supply of heat to the machine, as a result of which warping of the paper may occur. The use of this sheet delivery drum therefore frequently necessitates the provision of additional cooling and dampening apparatus for the blowing air, which likewise has a cost-increasing effect. Furthermore, such a porous air drum cannot be used as an impression cylinder. Although the heretofore known air drum can be used with some success in the delivery, it is, as mentioned above, unsuitable for a broader application in the printing press.

U.S. Pat. No. 3,126,826, describes in column 3, starting on line 49 thereof, a covering for a transfer drum which is in the form of a glass bead blanket. The glass beads are, for example, secured by adhesive to a rubber blanket and form, with the adhesive, a continuous, non-porous surface which exhibits a varying ink transfer behavior. While the sheet-supporting glass bead, substantially hemispherical projections readily transfer any received or accepted ink back to the sheet, the valleys therebetween which are formed of adhesive and rubber solution, respectively, tend toward ink build-up. The result is that such glass-bead blankets need frequent washing.

The heretofore known glass-bead blankets can be used only to a given extent on sheet delivery drums because, when the chain gripper makes the transition from the circular path of the sprocket wheel into the straight chain path, a speed which differs slightly from the surface speed of the outer cylindrical surface of the sheet delivery drum is imparted thereto. The resultant displacement of the freshly printed underside of the sheet relative to the covering, namely the glass-bead blanket, inevitably causes smearing of the printed image despite the relatively good ink transfer behavior of the glass bead spheres.

According to German Patent No. 12 58 873, it has furthermore been known heretofore to roughen, for example by sand-blasting, an aluminum plate which is clampable on the outer cylindrical surface of impression and sheet guiding cylinders, respectively, and then to coat the roughened surface of the aluminum plate with a thin layer of chromium. The supporting surface portions of the thus formed textured surface are of irregular height and of different size. Relatively pointed supporting surfaces are naturally more rapidly worn by the paper sheets than flat supporting surfaces. The carrier material or substrate, such as aluminum, for example, becomes exposed at the worn locations. The ink-transfer behavior of these exposed surfaces of the carrier or substrate material is so poor that the entire outer cylindrical surface is no longer suited for guiding freshly printed sheet sides when performing first form and perfector printing. This disadvantage notwithstanding, relative motion between the sheet guided by the impression and the transfer cylinder, respectively, and the thus chromed aluminum plate cannot be prevented.

From German Petty Patent (DE-GM) No. 79 11947.4, there has also become known to provide a sheet-guiding foil as a covering for impression cylinders of rotary offset printing machines for first form and perfector printing, one of the surfaces if which is formed smooth, and the opposite surface of which is formed with spherical calottes of equal height which are statistically uniformly distributed over the opposite surface. A chemically resistant, wear-resistant and inflexible carrier or substrate layer having relatively good ink transfer characteristics or behavior, formed of nickel, for example, has a thin chrome layer, which smooths out the micro-roughness, which is applied to the textured surface. This foil is not only suitable for transfer drums, but rather, quite especially for impression cylinders for smear-freely guiding sheets which have been printed on both sides thereof. Relative motion of the guided sheet and the guiding outer cylindrical surface of the cylinder and the drum, respectively, is also unable to be prevented, however, by such a foil.

It is accordingly an object of the invention to provide a covering for sheet-supporting cylinders and drums of the foregoing general type which ensures smear-free conveyance of sheets through an entire rotary offset printing press for printing both on single sides of a sheet as well as for first form and perfector printing.

With the foregoing and other objects in view, there is provided, in accordance with the invention, a covering for sheet-supporting cylinders and drums on rotary offset printing machines for printing both on single and both sides of a sheet, the covering having a smooth surface on one side thereof and a textured surface on the opposite side thereof, with sheet-supporting surfaces projecting from the textured surface and formed of hydrophilic and chemically and wear-resistant material, comprising means defining perforations formed in the textured surface, and means connected to the perforations for selectively applying blowing air and suction therethrough.

The use of a covering according to the invention on transfer drums, storage drums, turning cylinders, impression cylinders and sheet delivery drums ensures smear-free guidance of the printed sheets. The interaction between the hydrophilic, textured surface of a covering according to the invention and the air which is supplied or removed through the perforations formed therein causes the sheet either to be held firmly on the covering or to be conveyed without contact by means of this air cushion. If, nevertheless, during conveyance by means of an air cushion, the freshly printed side of the sheet briefly touches the elevations of the textured surface, this does not cause smearing. The quantities of air which are used can be kept within low limits by means of suitable control.

In accordance with other features of the invention, the perforations or penetrations provided in the textured surface of the covering according to the invention are disposed exclusively in the valley between the sheet-supporting surfaces. The cross sectional area of a perforation may at most be equal only to the cross-sectional area of one carrying surface or may cover several carrying surfaces and valleys of the textured surface. Also in accordance with the invention, the perforations are distributed over the entire textured surface in statistically uniform distribution. Of course, it is also practical, in accordance with the invention, for the perforations to be irregularly scattered over the textured surface. They may thereby be combined into groups.

In accordance with additional features of the invention, the perforations have a circular cross section or a cross section which is substantially similar to a circle, however, perforations in the form of polygons, e.g. in the form of squares, are also contemplated. The supporting surfaces of the textured surface may be in the form of spherical calottes, cylinders or truncated cones. The covering itself may consist of one or more layers. A nickel foil molded by galvanoplastic means has proven particularly advantageous in accordance with the invention. Its textured surface is chrome-plated. With such a nickel foil, in accordance with a method of the invention, perforations are molded together with the sheet-supporting surfaces by galvanoplastic means. However, the use of a glass bead blanket or of a plastic sheet or metal foil is also conceivable in accordance with the invention. The perforations are applied to such a covering by mechanical means, for example by punching, in accordance with an alternative method of the invention. Usually, the diameter of a perforation of the textured surface is less than 1 mm e.g. 0.3 mm.

In accordance with concomitant features of the invention, the covering according to the invention is used in combination with impression cylinders, transfer drums and delivery drums, and air openings are provided in the outer cylindrical surface of the respective cylinder or drum bearing the covering. Each of these air openings in the outer cylindrical surface of the respective cylinder or drum covers at least two, but preferably a greater number of the perforations formed in the covering.

Other features which are considered as characteristic for the invention are set forth in the appended claims.

Although the invention is illustrated and described herein as embodied in a covering for sheet-supporting cylinders and drums in rotary offset printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
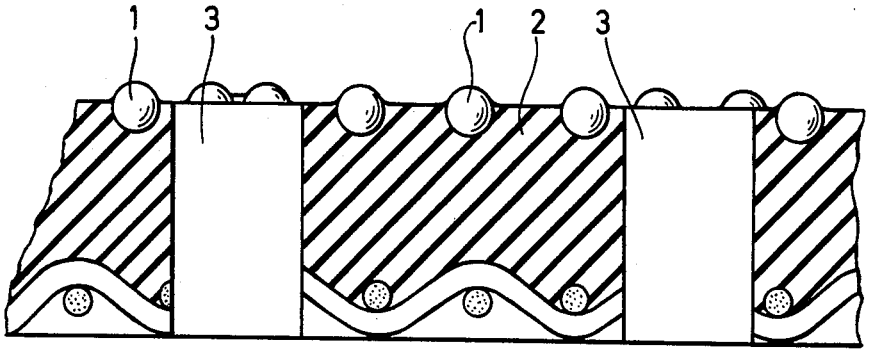
FIG. 1 is a cross-sectional view of part of a glass bead blanket according to the invention.

Referring now to the drawing and first, particularly to FIG. 1 thereof, there is shown, in cross-sectional view, a glass bead blanket corresponding to a commercially available so-called spherecote blanket. Asymmetrically scattered glass beads 1 protrude domelike from a sheet-supporting surface thereof. These glass beads 1 are vulcanized into the carrier material 2 of the glass bead blanket. The glass beads 1 are hydrophilic i.e. they eagerly return any ink which they have accepted from the freshly printed underside of the sheet. This means that they do not tend to accumulate ink. Therefore, these glass bead domes are suitable for supporting freshly printed undersides of sheets. The rubber-like carrier material 2 of the glass bead blanket is oleophilic, however, and therefore tends to accumulate ink. These glass bead blankets can, therefore, be used successfully only on sheet transfer drums whereon the sheet rests solely under its own weight or under slight tension.

Punched into the glass bead blanket in FIG. 1 are circular punctures or penetrations 3 through which, assuming that the outer cylindrical surface of a transfer drum is appropriately constructed, air can be blown out or sucked in. To blow air out, an air cushion is produced at least between the domes of the glass beads 1 so that the freshly printed underside of a sheet comes into contact only lightly with the domes of the glass beads, thereby avoiding any smearing of the ink which is still wet. When fresh air is sucked in through the penetrations or punctures 3, negative pressure or vacuum is produced under the guided sheet, as a result of which it is pressed firmly against the domes of the glass beads 1.

Figure 2:
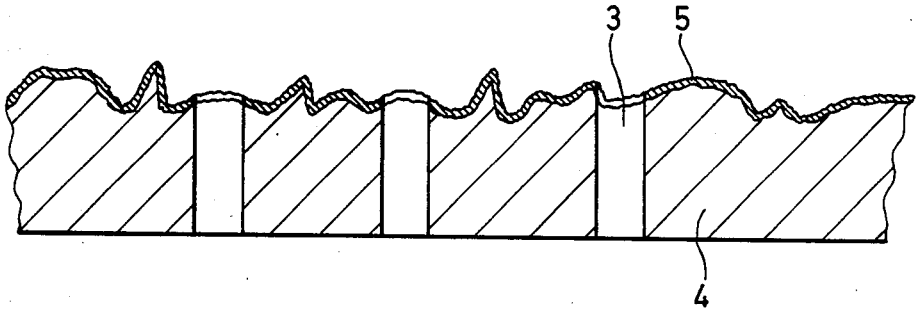
FIG. 2 is a cross-sectional view of part of a nickel-steel plate which is chrome-plated on one side thereof according to the invention.

Another covering constructed in accordance with the invention is shown in a cross-sectional view in FIG. 2. It is in the form of a nickel-steel plate 4, one surface of which is roughened, for example, by means of sandblasting and, thereafter, chrome-plated. The thin chrome cover layer 5 covers the entire roughened surface of the nickel-steel plate 4 which serves as a carrier therefor. By means of laser beams, very minute punctures or penetrations 3, for example with a diameter of 0.2 mm, have been burned into and through the covering in FIG. 2. These punctures or penetrations 3 are used both for blowing out air or for sucking in fresh air. It is thus likewise possible to produce above the roughened surface of the covering in FIG. 2, an air current which, in conjunction with the hydrophilic chrome cover layer 5, prevents smearing of the freshly-printed underside of a sheet, even if relative motion between the sheet and the covering occurs. If, nevertheless, a sheet is to be held firmly on the surface in order to prevent any possible relative motion, fresh air can be drawn in through the penetrations or punctures 3 so that a vacuum or negative pressure is produced between the underside of the sheet and the chrome upper layer 5. The rough, yet hydrophilic surface of the covering in FIG. 2 then holds the sheet immovably. Should the sheet finally be pulled off the covering in FIG. 2, the vacuum can be neutralized abruptly by a supply of air through the punctures or penetrations 3. The sheet can then be pulled off the hydrophilic surface without smearing.

Figure 3:
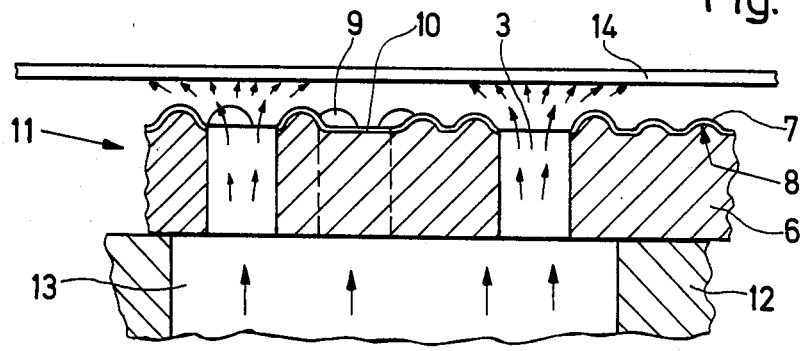
FIG. 3 is a cross-sectional view of part of a galvanoplastically produced nickel foil which is chrome-plated on one side thereof according to the invention.
Figure 4:
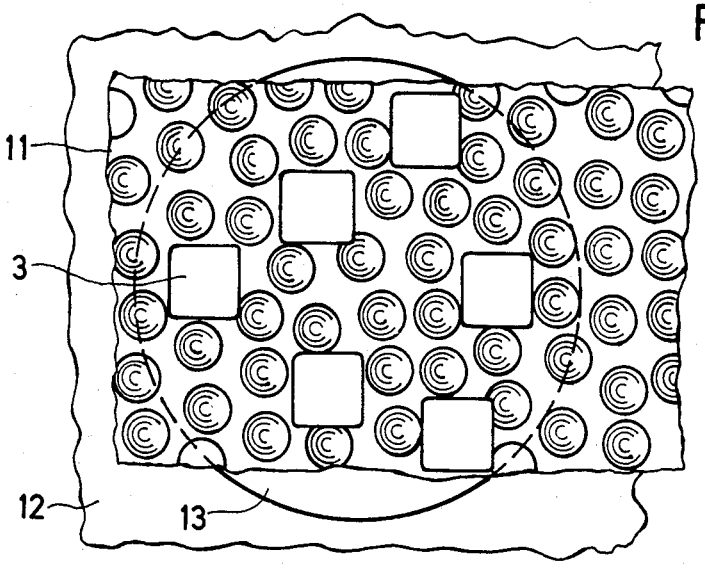
FIG. 4 is a top plan view of the foil shown in FIG. 3.

FIG. 3 shows an especially advantageous embodiment of the invention. Here again, precisely as in FIG. 2, the covering is formed of two layers, namely a nickel carrier layer or substrate 6 and a thin chrome cover layer 7 which is applied to the textured surface 8 of the nickel carrier layer 6. The texture of this textured surface 8 is formed of dome-shaped carrying or support surfaces 9 and interposed valleys 10. The dome-shaped support surfaces 9 are asymmetrically, yet statistically uniformly distributed over the textured surface 8. The covering 11 in FIG. 3 is provided in some valleys 10 thereof with penetrations or punctures 3 of square cross section which, as shown in FIG. 4, form a group thereof. The lateral edge of the square cross section may, for example, be 0.2 mm. The covering 11 in FIG. 3 can be manufactured by means of a conventional galvanoforming process. The penetrations or perforations 3 can also be formed at the same time.

As shown in FIG. 3, the covering 11 is clamped onto the outer cylindrical surface 12 of a cylinder or drum. Provided in this outer cylindrical surface 12, below a group of the penetrations or perforations 3, is a hole or bore 13 which has a diameter of approximately 2 mm and covers a group of the perforations or penetrations 3. Compressed air is supplied through the hole 13 and is blown out of the penetrations 3. Excess pressure or overpressure is thus formed above the chrome upper layer 7 of the covering 11 and lifts the conveyed sheet 14 so high that its freshly printed underside does not come into contact with the domes of the carrying or support surface 9.

Figure 5:
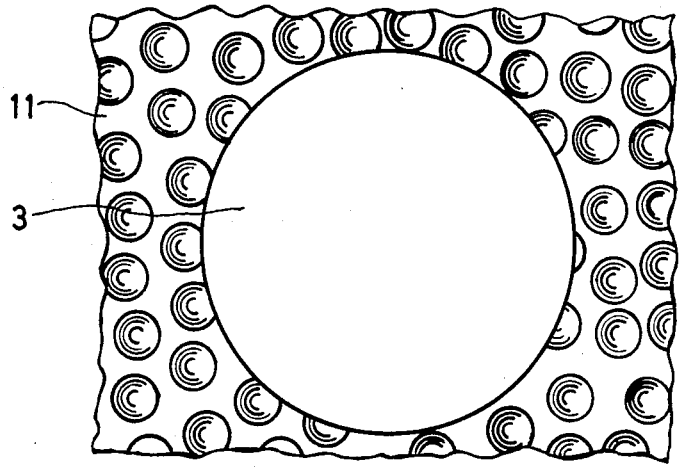
FIG. 5 is another view like that of the foil formed with relatively large punctures or penetrations.

It is also possible to provide perforations or penetrations 3 of larger diameter, for example, of approximately 2 mm, in the covering 11, as shown in FIG. 5. Such a covering could be used advantageously on a sheet delivery drum.

Figure 6:
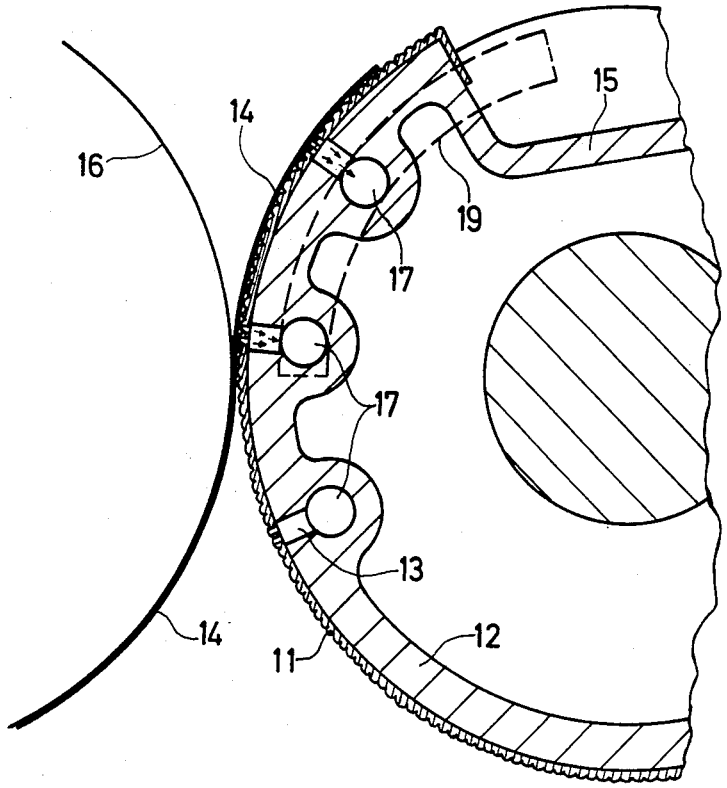
FIG. 6 is a cross-sectional view of an impression cylinder with a covering according to the invention in contact with a transfer drum.
Figure 7:
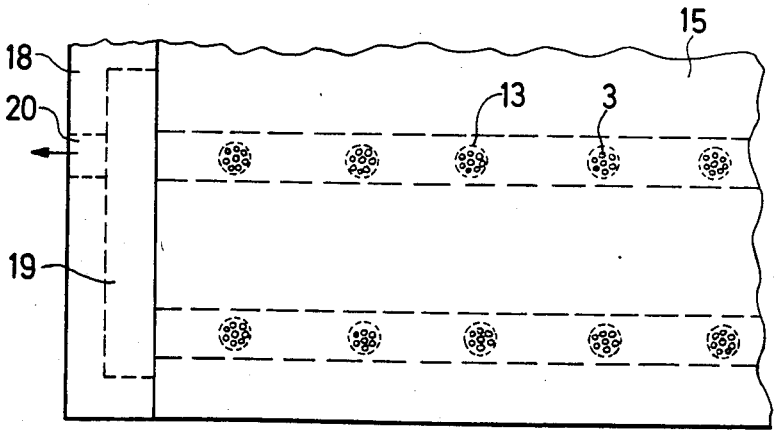
FIG. 7 is a fragmentary top plan view of the impression cylinder of FIG. 6.

From the impression cylinder 15 shown in partial cross-section in FIG. 6, a sheet 14 which has been printed on both sides thereof is transferred to a transfer drum 16. The impression cylinder 15 has a covering 11 like that of FIG. 3 clamped thereon. Disposed in the outer cylindrical surface 12 of the impression cylinder 15 are air ducts 17 which extend parallel to the rotational axis of the impression cylinder 15. As shown in FIG. 7, a valve disk 18 is provided at an end face of the impression cylinder 15 at a non-illustrated side wall of the printing machine. This valve disk 18 is formed with a control slot 19 which is connected to a vacuum generator via the bore 20. Air ducts 17 are disposed along the outer cylindrical surface 12 in a given region and are connected via the bores 13 to atmosphere. As described hereinbefore with reference to FIG. 3, the covering 11 is clamped onto the outer cylindrical surface 12 in such a manner that its groups of perforations or penetrations 3 respectively come into alignment with a hole or bore 13 of the air ducts 17.

If an air duct 17 is in the region of the control slit 19, air is sucked in through the perforations 3, and vacuum or negative pressure is produced at this point on the surface of the covering 11. The vacuum causes the sheet 14 to be sucked towards the covering 11, thus preventing it from falling forward or tumbling. Consequently, the sheet 14 cannot drop through the gap or nip between the impression cylinder 15 and the transfer drum 16. On the contrary, the sheet is accepted by the transfer drum 16 without being able to perform any motion relative to the surface of the covering 11. Approximately at the point of tangency of the impression cylinder 15 with the transfer drum 16, the air duct 17 leaves the control slit 19, whereupon the vacuum collapses and the sheet is consequently no longer pressed against the covering 11 at this point.

Figure 8:
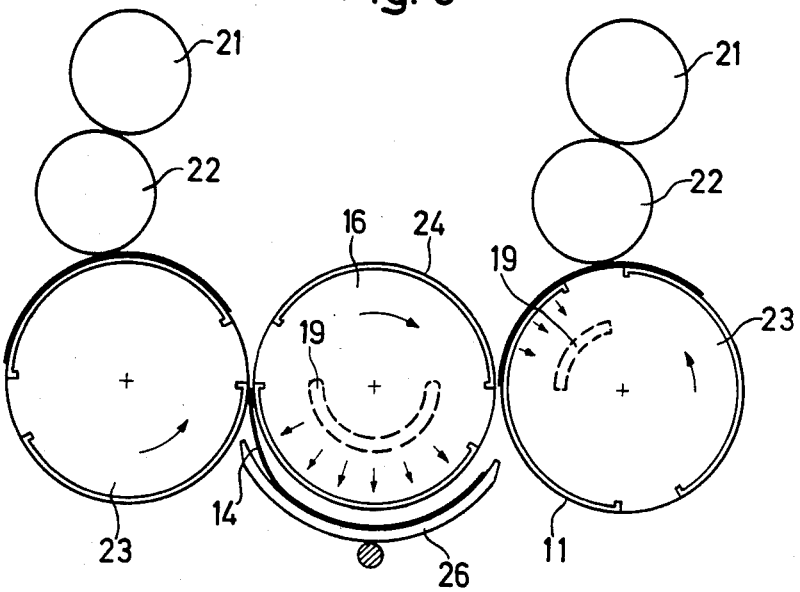
FIG. 8 is a diagrammatic view of two printing units of an offset rotary printing press for single-side multicolor printing.

The printing units shown diagrammatically in FIG. 8 are for printing on one side of a sheet. The printing unit 1 is formed of a plate cylinder 21, a rubber-covered or blanket cylinder 22 and an impression cylinder 23 having double the diameter of either of the cylinders 21 and 22. The impression cylinder 23 has coverings 11 clamped onto it. Its construction is the same as that of the impression cylinder 15 in FIG. 6. The control slit 19 causes a vacuum or negative pressure to be generated on the surface of the covering 11 when the sheet end has just left the gap or nip between rubber-covered or blanket cylinder 22 and the impression cylinder 23. As explained hereinbefore with reference to FIG. 6, this prevents the sheet from falling forward.

A transfer drum 16 of double diameter accepts the sheet from the impression cylinder 23. Sheet-supporting surfaces 24 of the transfer drum 16 may be equipped with a covering as in FIG. 1 i.e. with a glass-bead blanket which is likewise provided with perforations 3 scattered over the entire surface thereof. With appropriate construction of the outer cylindrical surface of the transfer drum 16, air is blown out, in the lower region thereof, with the aid of the control slot 19 so that the conveyed sheet 14 is brought into engagement with a sheet guide 26. The freshly printed sheet side consequently, barely contacts, if at all, the surface of the glass-bead blanket such as of FIG. 1, which is clamped onto the transfer drum 16. An impression cylinder 23 of the next following printing unit, which cooperates with a rubber-covered or blanket cylinder 22 and a plate cylinder 21, accepts the sheet 14 and guides it along the printing gap or nip where it receives a second impression of a one-sided multicolor print. This impression cylinder 23 also has coverings 11 clamped thereon as in FIG. 3.

Figure 9:
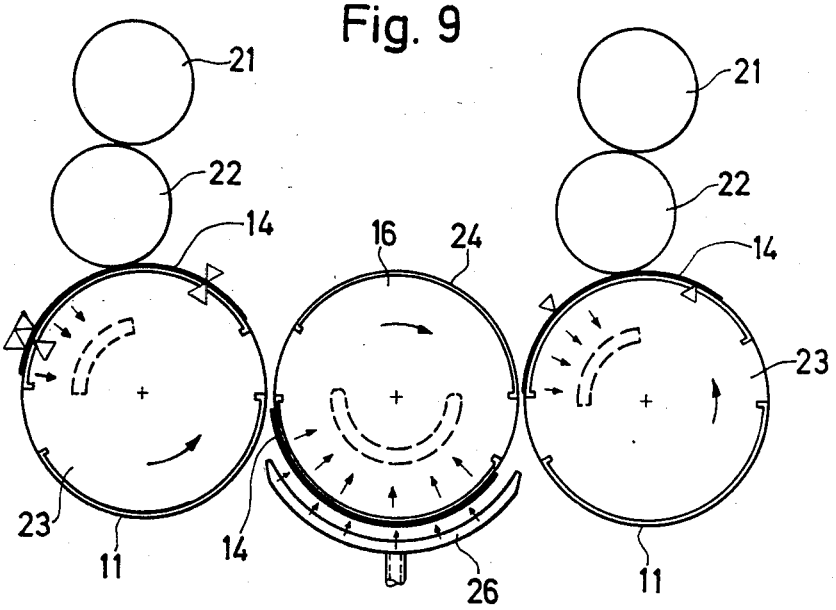
FIG. 9 is a diagrammatic view of two printing units of a convertible machine for either single side printing or first form and perfector printing.

FIG. 9 is a diagrammatic view of two printing units of a first form and perfector printing machine. The entire arrangement differs from that of FIG. 8 merely through the formation of the sheet guide 26 with blow-holes. The sheet 14 which is carried by the impression cylinder 23 of the first printing unit has already been printed one or more times on its underside. The impression cylinder 23 thus guides a turned sheet. With the aid of the plate cylinder 21 and the rubber-covered or blanket cylinder 22, the sheet, which has been printed on the underside thereof, receives its first perfecting print in this printing unit. After the sheet has passed through the printing gap or nip and after the front edge of the sheet has been accepted by the transfer drum 16, just as in FIG. 8, the sheet is pressed by means of a vacuum against the covering 11 of the impression cylinder 23 so that the sheet 14 cannot fall forward.

In the lower region of the transfer drum 16, air is then not blown out of the perforations of the covering as in FIG. 1, but rather is drawn or sucked in. In addition, an air cushion is formed above the sheet guide 26 by means of blowing air. A result thereof is that the two-sided freshly printed sheet 14 is pressed firmly against the dome-shaped supporting or carrying surfaces 1 of the covering as in FIG. 1. Motion of the sheet relative to the outer cylindrical surface of the transfer drum 16 cannot occur. Because the glass beads of the glass-bead blanket are hydrophilic, the thus-guided sheet 14 is accepted by the following impression cylinder 23 without any smearing of the contacting, freshly printed sheet side. On the impression cylinder 23 of the second printing unit shown in FIG. 9, in conjunction with plate cylinder 21 and rubber-covered or blanket cylinder 22 the sheet 14 is given the second perfecting print. The impression cylinder 22 is once again provided with coverings 11 so that neither in the printing gap nor briefly thereafter can there be any smearing of the first side which is still fresh.

Figure 10:
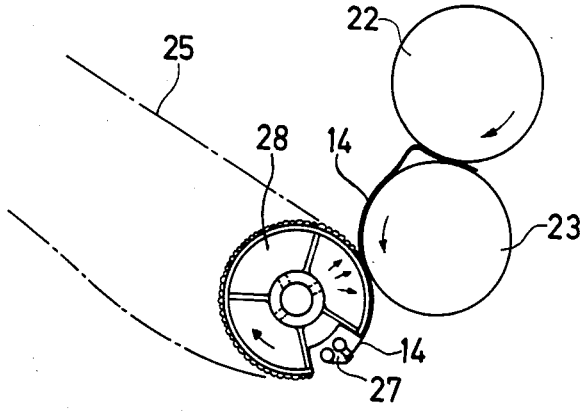
FIG. 10 is a diagrammatic views of the last blanket and impression cylinders of a multi-color offset rotary printing press and a sheet delivery cylinder and showing the transfer of a sheet to the chain delivery.
Figure 11:
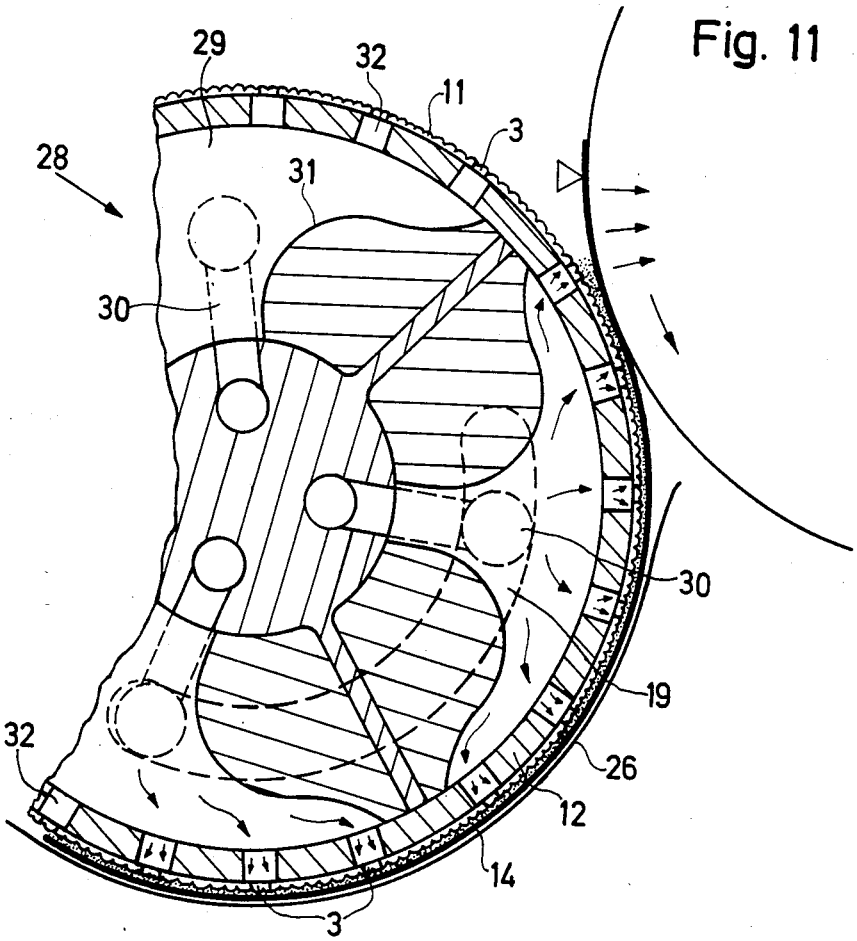
FIG. 11 is an enlarged, fragmentary cross-sectional view of FIG. 10, in another operating phase thereof.

A covering 11 as in FIG. 3 or as in FIG. 5 can also be used to particular advantage on a sheet delivery drum 28. This application is shown in FIGS. 10 and 11. From the diagrammatically represented impression cylinder 23 of the last printing unit, the sheet is transferred to the sheet delivery drum 28 of a delivery chain 25. After the end or edge of the sheet 14 has been pulled off the rubber-covered or blanket cylinder 22 it is prevented by suction from falling forward as a result of the special construction of the covering 11 clamped onto the impression cylinder 23. The instant the gripper bridge 27 of the delivery chain 25 leaves the circumference of the sheet delivery drum 28, a speed differing slightly from that of the periphery of the sheet delivery drum 28 is imparted to the sheet 14. This results forcibly in relative motion between the sheet-supporting outer cylindrical surface of the sheet delivery drum 28 and the underside of the sheet 14.

FIG. 11 shows how, through the use of the covering 11 according to the invention, the freshly printed underside of the sheet is prevented from smearing despite the relative motion. The sheet delivery drum 28 is provided with several blow chambers 29 having an air-saving and streamlined construction which was achieved with the aid of foamed-synthetic profile parts 31 e.g. polyurethane (PU) foam. The blow chambers 29 are temporarily or intermittently connected via control holes 30 and a control slot 19 to a non-illustrated compressed-air generator. Provided in the outer cylindrical surface 12 of the sheet delivery drum 28 is a number of blow-holes 32 which are disposed symmetrically with respect to penetrations or perforations 3 in the covering 11. As long as one of the control holes 30 is in the region of the control slot 19, air is blown out through the blow chamber 29 as well as through the blow holes 32 and penetrations or perforations 3 in the covering 11, so that an air cushion is formed above the textured surface of the covering 11 and presses the sheet 14 against a sheet guide 26. The freshly printed underside of the sheet, thus virtually fails to touch the textured surface of the covering 11. Despite the motion of the sheet relative to the surface of the covering 11, there is nevertheless no smearing of the freshly printed sheet side. However, even if the sheet were to touch the carrying domes of the covering 11 slightly, this would not cause any smearing of the printed image because the chrome cover layer 7 of the covering 11 is hydrophilic and would willingly or readily surrender the received ink. There is, therefore, no redistribution of ink.

Figure 12:
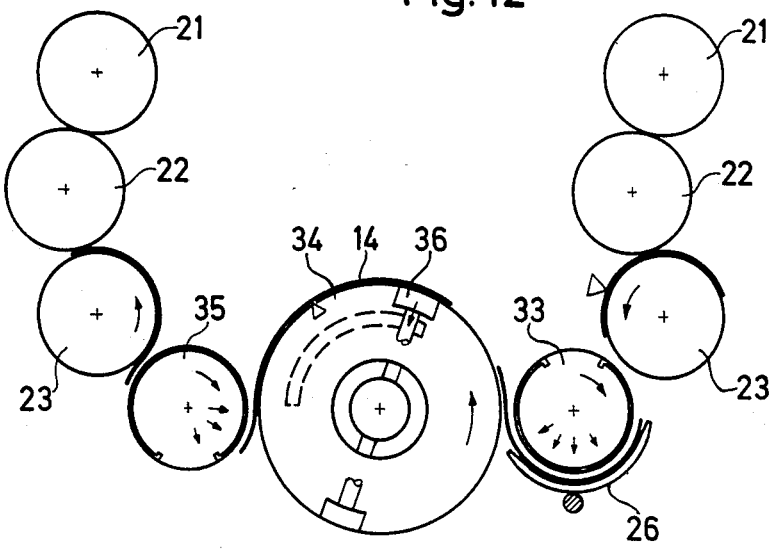
FIG. 12 is a view like that of FIG. 9 of two printing units of a convertible single-side and perfector printing machine together with a turning station.
Figure 13:
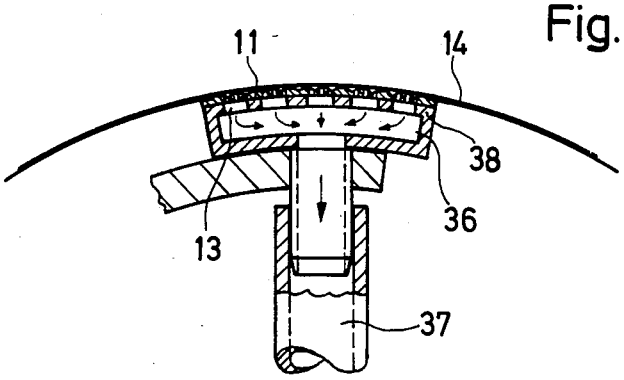
FIG. 13 is an enlarged, fragmentary sectional view of a storage drum of the turning station shown in FIG. 12.

Coverings according to the invention can also be used to great advantage at a sheet-turning station of a first form and perfector printing machine, as is diagrammatically shown in FIGS. 12 and 13. The first printing unit is formed of the plate cylinder 21, the rubber-covered or blanket cylinder 22 and the impression cylinder 23. The latter is followed by a transfer drum 33 which transfers the sheet 14 to a storage drum 34. From there, the turning cylinder 35 accepts the sheet by the leading or trailing edge thereof, depending upon the setting of the machine. From the turning cylinder 35, the sheet reaches the next-following impression cylinder 23. The latter cooperates with the plate cylinder 21 and the rubber-covered or blanket cylinder 23, as a result of which, depending upon the setting of the machine, the sheet 14 receives a first form or a perfector print in this printing unit.

The transfer drum 33 of single i.e. given unitary, diameter is provided with a covering as in FIG. 1 i.e. the sheet is pressed by means of blowing air against the sheet guide 26 so that the freshly printed sheet side does not come into contact with the sheet-supporting or supporting surface of the transfer drum 33. A storage drum 34, due to its double diameter, is provided with two-sheet-carrying surfaces and has an adjustable suction box 36 in the region of the trailing edge of the sheet. This suction box 36 is shown in enlarged form in FIG. 13 and can be set to the size or format of the sheet. The suction box 36 is connected via tubing 37 to a non-illustrated vacuum generator. The cover plate 38 of the suction box 36 is provided with holes 20 and has a covering 11 like that in FIG. 3 adhesively secured thereto. Respective groups of the penetrations or perforations 3 are covered by each hole 13. By applying suction to the rear region of the sheet 14 by means of the suction box 36, reliable smear-free acceptance of the trailing edge of the sheet by the pincer-type grippers of the turning cylinder 35 is assured. The suction box 36 thus prevents, in particular, the falling forward or dropping of the sheet 14 which has been printed on the underside thereof. The hydrophilic surface of the covering 11 additionally prevents smearing of the print on the underside of the sheet.

A consistent use of coverings according to the invention on all cylinders and drums of a rotary printing press ensures smear-free, reliable carrying or support of sheets. To prevent clogging of the penetrations or perforations 3 in coverings, particularly if used on impression cylinders, air can be blown out briefly when in a given angular position wherein the covering is not supporting any sheet; in this way, the penetrations or perforations 3 of the covering can be adequately cleaned of ink and dust. Quite generally, there is the possibility of changing from blowing to sucking and vice versa. Besides being able to use the suction box 36 on storage drums, it can also be used with normal transfer drums of double diameter.

I claim:

1. Covering for sheet-supporting cylinders and drums on rotary offset printing machines for printing both on single and both sides of a sheet, the covering having a smooth surface on one side thereof and a textured surface on the opposite side thereof, with sheet-supporting surfaces projecting from the textured surface and formed of hydrophilic and chemically and wear-resistant material, comprising non-sheet supporting area disposed on the textured surface at the bottom of and forming valleys between the projecting surfaces, means defining perforations formed in the textured surface, and means connected to said perforations for selectively applying blowing air and suction therethrough.

2. Covering according to claim 1 wherein said perforations are formed exclusively in said valleys.

3. Covering according to claim 2 wherein said perforations, respectively, have a cross-sectional area greater than the combined cross-sectional areas of a plurality of the projecting sheet-supporting surfaces and said valleys.

4. Covering according to claim 1 wherein said perforations, respectively, have a cross-sectional area equal maximally to the cross-sectional area of one of the projecting sheet-supporting surfaces.

5. Covering according to claim 1, wherein said perforations are distributed in a statistically uniform distribution over the entire textured surface.

6. Covering according to claim 1 wherein said perforations are irregularly scattered over the textured surface.

7. Covering according to claim 1 wherein pluralities of said perforations which are mutually adjacent are combined into groups.

8. Covering according to claim 1 wherein said perforations have a substantially circular cross section.

9. Covering according to claim 1 wherein said perforations have a polygonal cross-sectional shape.

10. Covering according to claim 9 wherein said perforations have a square-shaped cross section.

11. Covering according to claim 1 wherein the projecting sheet-supporting surfaces are formed as spherical calottes.

12. Covering according to claim 1 wherein the projecting sheet-supporting surfaces are formed as cylinders.

13. Covering according to claim 1 wherein the projecting sheet-supporting surfaces are formed as truncated cones.

14. Covering according to claim 1 including a plurality of layers.

15. Covering according to claim 1 being formed as a plastic sheet.

16. Covering according to claim 1 being formed as a metal foil.

17. Covering according to claim 1 wherein said perforations, respectively, have a diameter less than one millimeter.

18. Covering according to claim 17 wherein said diameter is 0.3 mm.

19. Covering according to claim 1 in combination with a cylindrical sheet-supporting member of a rotary offset printing machine, wherein the covering is mounted on the cylindrical surface of said member, said cylindrical surface being formed with holes, each of which covers at least two of said perforations formed in the covering.

20. The combination according to claim 19 including sheet guides formed with air outlet openings and disposed below said cylindrical member.

21. The combination according to claim 20 wherein said sheet guides are disposed equidistantly from said cylindrical surface of said member.

22. Covering according to claim 1 in combination with a suction box adjustable to a sheet format, said suction box having a surface perforated with suction openings and covered by the covering.

23. The combination according to claim 22 wherein said surface of said suction box is on a cover plate to which the covering is adhesively secured, each of said suction openings formed in said cover plate covering a plurality of the perforations formed in the textured surface of the covering.

24. Covering for sheet-supporting cylinders and drums on rotary offset printing machines for printing both on single and both sides of a sheet, the covering having a smooth surface on one side thereof and a textured surface on the opposite side thereof, with sheet-supporting surfaces projecting from the textured surface and formed of hydrophilic and chemically and wear-resistant material, comprising means defining perforations formed in the textured surface, and means connected to said perforations for selectively applying blowing air and suction therethrough, the covering being formed as a glass-bead blanket.

* * * * *